United States Patent [19]

Putz

[11] 4,030,861

[45] June 21, 1977

[54] VARIABLE DISPLACEMENT ROTARY PISTON EXPANSIBLE CHAMBER DEVICE

[76] Inventor: A. Frank Putz, 401 N. 89th St., Wauwatosa, Wis. 53226

[22] Filed: Nov. 17, 1975

[21] Appl. No.: 632,853

Related U.S. Application Data

[63] Continuation-in-part of Ser. No. 553,332, Dec. 16, 1974.

[52] U.S. Cl. ..... 418/27; 418/31; 418/54

[51] Int. Cl.[2] ..... F04C 15/00

[58] Field of Search ..... 418/24, 25, 26, 27, 418/31, 54, 58, 59

[56] References Cited

UNITED STATES PATENTS

| | | | |
|---|---|---|---|
| 1,340,625 | 5/1920 | Planche | 418/54 |
| 1,802,887 | 4/1931 | Feyens | 418/54 |
| 2,633,805 | 4/1953 | Haugdahl | 418/27 |

*Primary Examiner*—Carlton R. Croyle
*Assistant Examiner*—Leonard Smith
*Attorney, Agent, or Firm*—Lee H. Kaiser

[57] ABSTRACT

A pressure compensated, variable volume, rotary piston device has a housing with an elongated cavity and inlet and exhaust ports; a reaction ring movable within the cavity and defining a cylindrical bore; a lenticular rotary piston rotatable and reciprocable radially within the bore and dividing it into first and second variable volume chambers; a shaft rotatably journalled in the housing and carrying a crankarm which constitutes the sole force transmitting means between shaft and piston and is operatively coupled to the piston so that shaft and piston rotate in a one-to-one ratio while the piston rocks relative to the crankarm and, without the use of phasing gears, the apices of the rotary piston remain in continuous contact with the bore in all positions of the rotary piston and in all positions of the reaction ring within the cavity and so cam the piston that it reciprocates within the bore as it rotates and varies the volume of the first and second chambers inversely from minimum to maximum and back to minimum during each revolution of the shaft; a reaction spring for resiliently urging the reaction ring to a position against a stop wherein the eccentricity between the axes of the shaft and the cylindrical bore is maximum; and means accessible from the exterior of the housing for selectively varying the force of the reaction spring to thereby adjust the fluid displacement.

38 Claims, 16 Drawing Figures

VARIABLE DISPLACEMENT ROTARY PISTON EXPANSIBLE CHAMBER DEVICE

This application is a continuation-in-part of my application Ser. No. 553,332 filed Dec. 16, 1974.

This invention relates to expansible chamber, rotary piston devices such as pumps and hydraulic motors and in particular to variable volume, rotary piston expansible chamber devices.

It is an object of the invention to provide an improved rotary piston, variable displacement, expansible chamber device having novel motion transmitting means between shaft and rotary piston which maintains continuous engagement between apices on the rotary piston and the working chamber surface as the rotary piston is repositioned within the chamber without the necessity of phasing gears required in prior art structures and regardless of the fluid pressure or the volumetric displacement of the device. A further object is to provide such a variable displacement, rotary piston device wherein novel motion transmitting means simultaneously rotates and radially reciprocates the rotary piston within the working chamber so that the arcuately spaced apices on the rotary piston maintain continuous contact with the working chamber surface with substantially zero radial movement of the apex seals irrespective of the fluid pressure or of the volume displaced and so that the rotary piston varies the volume of a plurality of expansible chambers from minimum to maximum and back to minimum during each revolution of the shaft. Another object is to provide such a variable volume, rotary piston, expansible chamber device wherein the displacement is selectively variable. Still another object is to provide such a variable volume, rotary piston, expansible chamber device which is pressure compensated so that the volume displaced is a function of the fluid pressure. A still further object is to provide such a variable volume, pressure compensated, rotary piston device wherein the maximum pressure of the fluid can be selectively adjusted. Another object is to provide such a variable displacement, rotary piston device which, when operated as a pump, permits selective adjustment of the maximum pressure at which the flow begins to decrease to zero, or which, when operated as a hydraulic motor, permits selective adjustment or motor speed.

Another object of the invention is to provide an improved rotary piston, variable displacement, expansible chamber device wherein the rotary piston is rotated and reciprocated radially within a cylindrical bore formed in a chamber-defining member to vary the volume of a plurality of expansible chambers from minimum to maximum and back to minimum during each revolution of the shaft and the chamber-defining member is movable within an elongated cavity in the housing to vary the volume of fluid displaced and the rotary piston is cammed as it revolves to that spaced apices thereon maintain continuous contact with the working chamber surface in all positions of the piston and so that a straight line connecting the rotary piston apices remains perpendicular to a rotatable reference diameter through the center of the closed curve defining the cylindrical bore cross section in all positions of the rotary piston and in all positions of the chamber-defining member within the elongated cavity in the housing. A further object is to provide such a variable displacement, rotary piston device wherein the geometric center of the rotary piston cross section is reciprocated along such reference diameter as the rotary piston revolves within the bore to vary the volume of a plurality of chambers inversely during each revolution of the shaft.

SUMMARY OF THE INVENTION

A variable displacement, rotary piston, expansible chamber device such as a pump or fluid motor embodying the invention has a housing with an elongated cavity registering with inlet and exhaust ports and a chamber-defining member movable within the cavity and having a cylindrical bore therein defining a working chamber in which a rotary piston having spaced apices simultaneously revolves and reciprocates radially to vary the volume of first and second chambers formed on opposite sides of the rotary piston from minimum to maximum and back to minimum during each revolution of a shaft. The chamber-defining member is movable within the elongated cavity to vary the eccentricity between the axes of the cylindrical bore and of the shaft and thus change the volume of fluid displaced. The shaft carries force transmitting member and is operatively connected to the rotary piston so that rotary piston and shaft rotate together in a one-to-one ratio and the rotary piston simultaneously rocks relative to the force transmitting member so that, within the use of phasing gears, the piston apices maintain continuous contact with the working chamber surface in all positions of the rotary piston and in all positions of the chamber-defining member within the elongated cavity and with substantially zero radial movement of the apex seals. The force transmitting member is operatively connected to the rotary piston at a point radially outward from the geometric center of the piston cross section and the piston is cammed by its apices in sliding contact with the bore into rocking motion relative to the force transmitting member so that a straight line connecting the apices remains perpendicular to a rotatable reference diameter through the center of the closed curve defining the bore cross section in all positions of the rotary piston within the bore and in all positions of the chamber-defining member within the elongated cavity. In a preferred embodiment the chamber-defining member is a reaction ring, and a reaction spring resiliently urges the reaction ring to a position against a stop wherein eccentrically between shaft and reaction ring is maximum so that maximum fluid displacement is obtained until the fluid pressure increases sufficiently so that the reaction force moves the reaction ring against the force of the reaction spring to decrease eccentricity, and thus displacement.

DESCRIPTION OF THE DRAWINGS

The above and other objects and advantages of the invention will be more readily apparent from the following detailed description when considered in conjunction with the accompanying drawings wherein:

FIGS. 10*a*–10*f* are schematic views respectively showing successive positions of the rotary piston of the device of FIGS. 8 and 9 taken 60° apart as it rotates clockwise within the bore and illustrating the intake and discharge ports in dotted lines; and FIG. 11 is a graph showing out-of-phase fluid displacement by the rotary piston flanks and the crankarm which reduces ripple in the delivery when operated as a pump.

Referring to FIGS. 1–3 of the drawing, a variable displacement, pressure compensated, rotary piston pump embodying my invention has a housing 10 comprising end sections 11 and 12 and an intermediate section 14 interposed between end sections 11 and 12 and held firmly therebetween by a plurality of screws 15 (see FIG. 3). Screws 15 may extend through aligned clearance holes in end section 11 and in intermediate section 14 and into threaded holes in end section 12 and retain the three sections 11, 12, 14 together in a unitary housing. Intermediate section 14 has an elongated cylindrical internal cavity 16 whose cross section is preferably obround. A working chamber-defining or bore-defining member RR shown as an annular reaction ring is positioned within internal cavity 16 and is free to move along the longitudinal axis of cavity 16. Bore-defining reaction ring RR has an internal cylindrical wall 17 which defines the surface of the working chamber, or bore of the pump. The cross section of the bore 17 is a closed curve U (see FIG. 5) which may be circular, as shown in FIGS. 1–3 wherein the chamber-defining member RR is an annular reaction ring, or may be generally elliptical as shown in FIG. 5 and disclosed in my parent application Ser. No. 533,332 filed Dec. 16, 1974.

Figure 1:
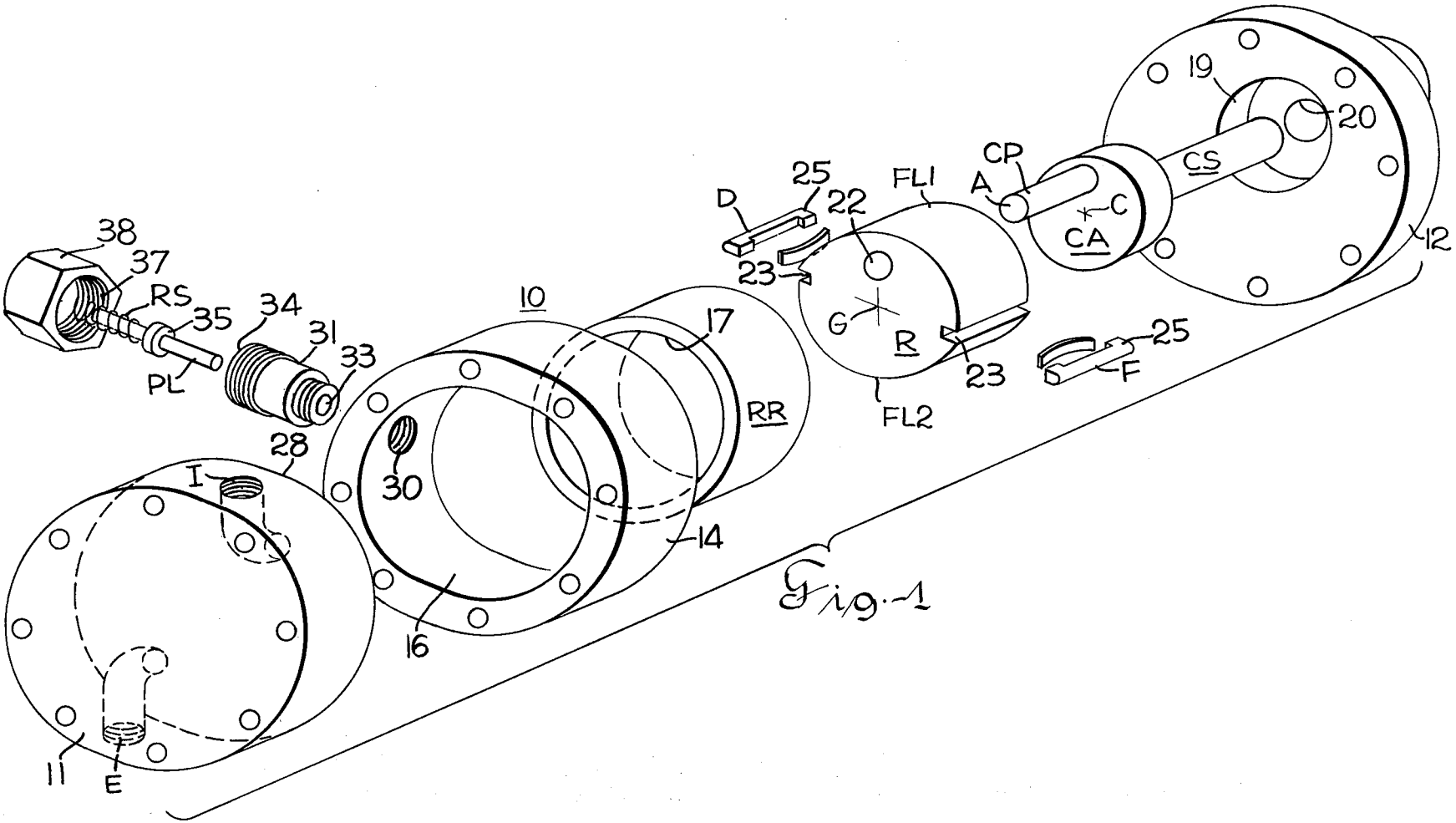
FIG. 1 is an exploded view of a variable displacement rotary piston pump embodying the invention utilizing an overhung crankshaft and crankpin to operatively connect shaft to rotary piston.

End section 12 has a cylindrical compartment 19 of circular cross section therein communicating with internal cavity 16 and whose axis is parallel to the axis of cylindrical bore 17 in chamber-defining reaction ring RR. End section 12 also has a cylindrical opening 20 coaxial with compartment 19 in which a cantilevered, or overhung crankshaft CS is rotatably journalled. Crankshaft CS has a circular crankarm CA coaxial therewith disposed within compartment 19 and carrying a crankpin CP positioned radially outward from and parallel to the crankshaft axis C and protruding into cavity 16 and bore 17.

A rotary piston R positioned within bore 17 in chamber-defining member RR for rotation and radial reciprocation therein is prefereably lenticular in cross section. The geometric center G (see FIGS. 2 and 5) of the lenticular cross section of rotary piston R lies along the straight line connecting its apices D and F, and rotary piston R has a crankpin-receiving aperture 22 radially outward from the geometric center G into which crankpin CP extends. Preferably the distance from geometric center G to the axis of crankpin-receiving aperture 22 is equal to the length of the crankarm; i.e., the distance from axis C of crankshaft CS to the axis A of crankpin CP. Rotary piston R has apex seal slots 23 at its apices D and F which extend longitudinally of its lenticular cross section and slidably receive flat apex seal plates 25. Although apex seal plates 25 physically contact the working chamber surface 17, the radial movement of such seal plates within slots 23 is so minute that such seal plates may be considered the apices, i.e., the tips D and F of rotary piston R which "track" along the bore 17. Crankarm CA is the sole force transmitting means between rotary piston R and crankshaft CS, and continuous sliding contact between bore surface 17 and apices D and F in all positions of rotary piston R is accomplished by my invention without the necessity of phasing gears required in prior art rotary piston, variable volume devices. Rotary piston R is pivotally coupled to crankarm CA about crankpin CP so that it rotates together with crankshaft CS in a one-to-one ratio within bore 17 while apices D and F remain in continuous sliding contact with bore 17 and cam rotary piston R as it rotates so that it rocks relative to the crankarm CA and also so that the straight line connecting apices D and F remain perpendicular to a rotatable "reference diameter" OGA (see FIG. 5) through the center of bore cross section curve U in all positions of rotary piston R and in all positions of reaction ring RR within cavity 16 and also so that first and second expansible chambers C1 and C2 formed between the flanks FL1 and FL2 of rotary piston R and bore 17 vary inversely from minimum volume to maximum volume and back to minimum during each revolution of crankshaft CS. Apices D and F are also cammed on bore 17 as rotary piston R rotates so that geometric center G reciprocates along the reference diameter OGA.

The radially extending interior surface 28 of end section 11 has an inlet, or suction port I which at its inner end communicates with the exterior of the housing 10. Interior surface 28 of end section 11 also has an exhaust, or discharge port E which at its inner end communicates with internal cavity 16 and bore 17 at a point arcuately spaced from suction port I and at its outer end communicates with the exterior of housing 10. The inner ends of inlet port I and discharge port E are spaced apart along a line approximately perpendicular to the longitudinal axis of elongated cavity 16.

Intermediate section 14 has a radially extending threaded aperture 30 aligned with the longitudinal axis of obround internal cavity 16 into which a tubular bushing 31 having external threads is secured. Bushing 31 has a central opening 33 which registers with internal cavity 16 and in which a plunger PL slidably reciprocates so that the inner end of plunger PL abuts against chamber-defining reaction ring RR internally of housing 10. Bushing 31 also has an enlarged diameter compartment 34 which slidably receives an enlarged diameter circumferential projection 35 on plunger P1 intermediate its ends and which limits radially inward toward travel of plunger PL. The outer end of plunger PL extends into the axial opening in a compression type reaction spring RS which at its inner end abuts against circumferential projection 35. The outer end of reaction spring RS extends into a threaded opening 37 in a pressure adjusting cap 38 and abuts against the top surface thereof. The female threads on pressure adjusting cap 38 engage external threads on bushing 31, and the exterior or cap 38 may be of hexagon shape so that it may be engaged by an open end wrench. It will be appreciated that turning of pressure adjusting cap 38 relative to bushing 31 varies the loading of reaction spring RS which is compressed between projection 35 and the upper surface of cap 38 and thus changes the force with which reaction spring RS resiliently urges chamber-defining ring RR toward one end of internal cavity 16 wherein eccentricity *e* between the axes of shaft CS and cylindrical bore 17 is maximum so that maximum fluid displacement is obtained.

Figure 5:
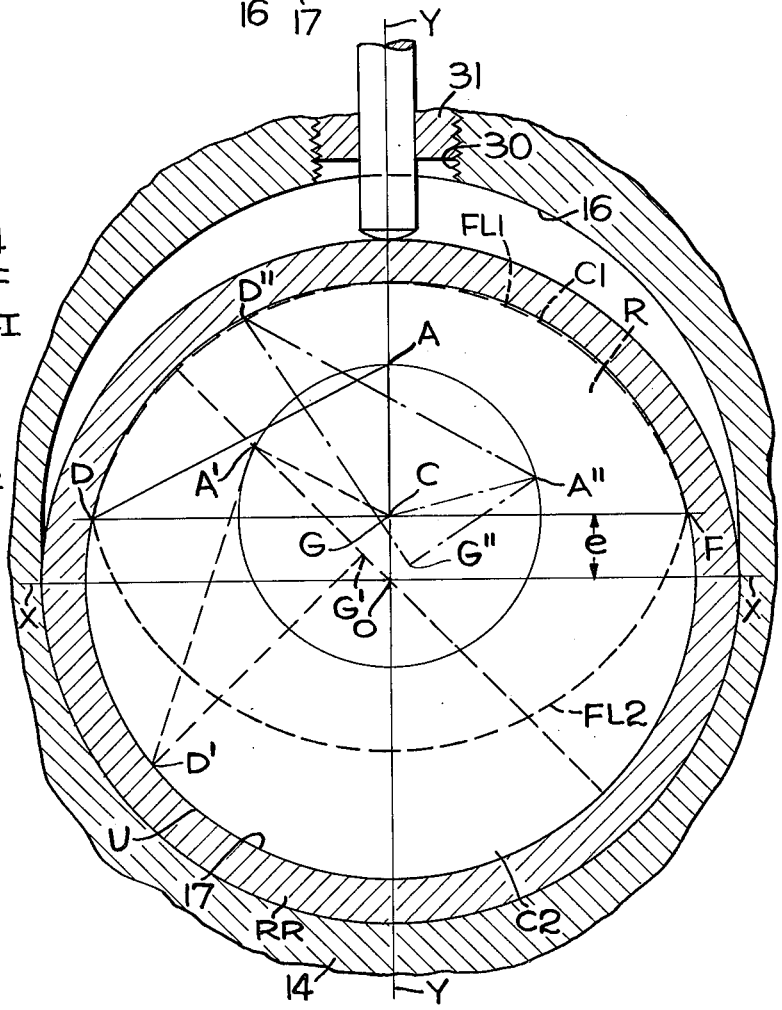
FIG. 5 illustrates the development of the cross section of the bore of a variable volume, rotary piston device embodying the invention.

Flanks FL1 and FL2 on diametrically opposed sides of lenticular rotary piston R between apices D and F are generally complementary to bore surface 17 whose cross sectional curve U may be defined relative to rectangular coordinates axes X and Y which pass through the center 0 of closed curve U (see FIG. 5). The volume of fluid pumped; i.e., the displacement, is a function of the eccentrically *e* between the center O of curve U and the axis C of crankshaft CS and increases when such eccentricity increases. Irrespective of the degree of such eccentricity (and thus of the position of reaction ring RR within cavity 16), rotary piston R assumes during each revolution of crankshaft CS both a top dead center (TDC) position, wherein the axis A of crankpin CP coincides with coordinate axis Y above the X axis and flank FL1 is closely contiguous the portion of bore 17 containing aperture 30, and a bottom dead center (BDC) position wherein the axis A of crankpin CP coincides with coordinate axis Y below the X and axis and flank FL2 is closely contiguous the portion of bore 17 containing aperture 30. In the TDC position wherein flank FL1 closely approaches bore 17 and blocks communication between suction port I and discharge port E, the volume of first chamber C1 is a minimum; flank FL2 has maximum spacing from bore 17 and the volume of second chamber C2 is maximum; the longitudinal axis DF of rotary piston R is perpendicular to the Y axis; and the geometric center G of rotary piston R lies along the Y axis. Further, in the TDC position the geometric center G of rotary piston R coincides with crankshaft axis C when eccentricity *e* is maximum. After 180° rotation of crankshaft CS from the TDC position to the BDC position wherein axis A of crankpin CP coincides with coordinate axis Y below the X axis, the rotary piston geometric center G again lies along the Y axis at the same position tht it occupied at TDC; the longitudinal axis DF of rotary piston R is perpendicular to the Y axis; flank FL2 is closely contiguous the portion of bore 17 containing aperture 30 so that communication between inlet and dicharge ports is blocked and the volume of second chamber C2 is minimum; flank FL1 is spaced a maximum distance from the portion of bore 17 intersected by the Y axis below the X axis so the volume of first chamber C1 is maximum; and geometric center G of rotary piston R is again coincident with shaft axis C (if eccentricity e of reaction ring relative to crankshaft axis C is maximum).

Rotary piston R revolves in a one-to-one ratio with crankshaft CS, and apices D and F of rotary piston R remain in continuous sliding contact with bore 17, regardless of the position of piston R within bore 17 and regardless of eccentricity e between the axes of crankshaft CS and bore 17, and cam rotary piston R as it is revolved by crankarm CA so that geometric center G of rotary piston R reciprocates along the reference diameter OGA and varies the volume of chambers C1 and C2 inversely. As rotary piston R goes from TDC to BDC, fluid is induced into chamber C1 through port I and fluid in chamber C2 is squeezed out of exhaust port E. Similarly, as rotary piston R goes from BDC to TDC, fluid is forced out of chamber C1 through discharge port E and fluid is induced into chamber C2 through inlet port I.

FIG. 5 illustrates the development of the closed curve U which defines the cross section of the working chamber surface 17 with which piston apices D and F remain in continuous sliding engagement as piston R revolves so that substantially zero radial movement of apex seal plates 25 occurs. Curve U as shown in FIG. 5 is generally elliptical instead of being circular as in the embodiment of FIGS. 1–3, and the coordinate axes X and Y comprise the major and minor axes respectively of ellipitcal curve U which intersect at the center O of curve U. Minor axis Y is coincident with the longitudinal axis of internal cavity 16 so that the axis C of crankshaft CS is offset by eccentricity e from center O along the minor axis Y. Chamber-defining member RR is illustrated at the position wherein eccentricity *e* is maximum, geometric center G of the cross section of rotary piston R coincides with crankshaft axis C; and the length of the chord of curve U perpendicular to the minor axis Y through crankshaft axis C is equal to the diameter of curve U along minor axis Y; and geometric center G is coincident with shaft axis C.

Assume that an imaginary right plane triangle ADG whose base DG is equal to approximately twice its altitude GA is pivotally connected at the vertex A (which is analogous to and given the same designation as the crankpin axis) opposite its base to the radially outer end of an imaginary constant radius link CA (which is analogous to and given the same designation as the crankarm) whose length is substantially equal to altitude GA and whose center of rotation C if offset by eccentrically *e* from the center O of curve U along coordinate axis Y. Assume further that traingle ADG is rotated with imaginary link CA so that altitude GA remains coincident with a rotatable "reference" diameter OGA which passes through center O in all positions of imaginary link CA as the link rotates. During one complete revolution of imaginary link CA together with triangle ADG, the locus of points traced by triangle vertex D is the generally elliptical curve U whose diameter along minor axis Y is twice the length of base DG of triangle ADG.

Triangle ADG is shown in full lines at the TDC position in FIG. 5. This same triangle is shown in dashed lines and designated D'G'A' after 60° counterclockwise rotation of the imaginary link (CA') from TDC and is also shown in dot-dash lines and designated D'λ 'G''A'' after 315° counterclockwise revolution of the imagniary link (CA'') from TDC.

Now if an isoceles triangle ADF whose altitude GA is equal to that of triangle ADG and whose base DF has a length equal to twice that of triangle ADG is pivotally connected to imaginary link CA at vertex A, and if vertex D of isoceles triangle ADF is moved along locus of points U, then the other vertex F of isoceles triangle ADF will also be in substantially continuous contact with the generally elliptical curve U defining the cross section of bore 17 at all positions of imaginary link CA regardless of the eccentricity *e*.

Figure 2:
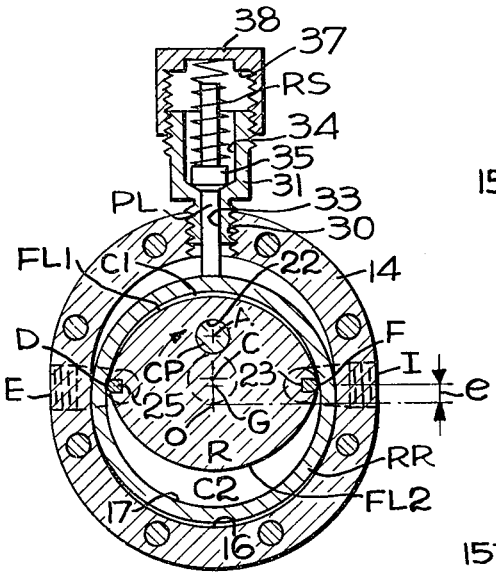
FIGS. 2 and 3 are cross section views respectively taken radially and axially through the assembled device of FIG. 1.
Figure 3:
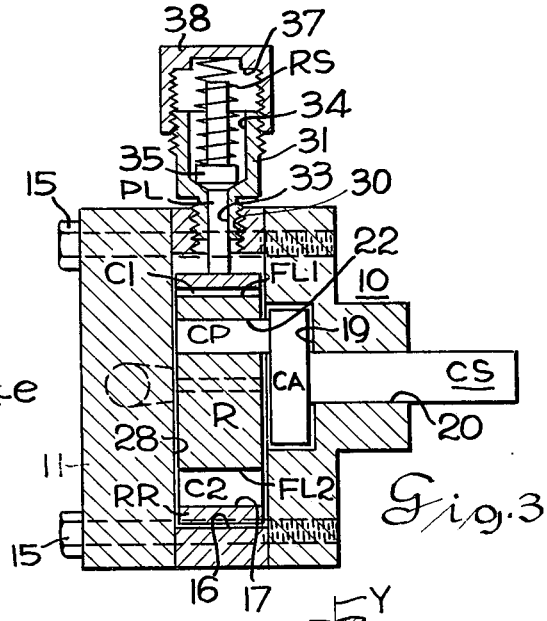

It will be appreciated that crankarm CA of the embodiment of FIGS. 1–3 is analogous to the imaginary constant radius link with the crankpin axis at triangle vertex A; that the center of rotation of imaginary link CA is analogous to the axis C of crankshaft CS; that triangle altitude GA is analogous to the radial displacement of the axis of crankpin-receiving aperture 22 from geometric center G; and also that isoceles triangle base DGF is congruent with the longitudinal axis of the rotary piston cross section connecting apices D and F. The apices D and F in sliding contact with working chamber surface 17 cam piston R into rocking or pivotal motion about crankpin CP as it revolves in a one-to-one ratio with shaft CS so as to accomplish the equivalent result of maintaining triangle altitude GA (and G'A' and G''A'') congruent to the rotatable reference diameter intersecting center O, vertex A, and geometric center G in all positions of piston R and despite variations in eccentricity *e*, and this is another manner of stating that apices D and F in continuous sliding contact with working chamber surface 17 so cam rotary piston R that it pivots about crankpin CP and longitudinal axis DF remains perpendicular to this reference diameter (which also assumes the A'G'O and A''G''positions) in all positions of piston R within bore 17 and in all positions of member RR within cavity 16 and so its geometric center reciprocates along this reference diameter.

I have found that when curve center O is offset along minor axis Y from crankshaft axis C by approximately 5 percent of the length of the bore diameter along the minor axis, the locus of points traced by triangle vertex D is approximately a circle. Further, when curve center O is offset along minor axis Y from crankshaft axis C by eccentricity e equal to approximately 10 percent of the length of the bore diameter along minor axis Y, the locus of points traced by traingle vertex D is a generally elliptical curve whose diameter along the major axis S is approximately 102 percent of the diameter along the minor axis Y. When eccentricity e is approximately 10 percent of the bore diameter along the minor axis and curve U is generally elliptical, the apices D and F still remain in continuous sliding engagement with the working chamber surface 17 in all positions of rotary piston R and substantially zero movement of the apex seals 25 occurs.

Delivery of the pump is proportional to eccentricity *e*. Changing the position of chamber-defining member RR within cavity 16 varies the eccentricity and thus changes displacement; i.e., delivery. When the force of reaction spring RS acting on reaction ring RR is higher than the thrust (i.e., the reaction forces of fluid being squeezed out of discharge port E) of the reaction ring RR, eccentricity and displacement are maximum. As fluid discharge pressure increases, the reaction force pushes the chamber-defining member RR against spring RS to thereby decrease eccentricity, and hence delivery. At a predetermined fluid output pressure, the eccentricity e between curve center O and crankshaft axis C is reduced to such a small value that flow is reduced to zero. The predetermined pressure at which displacement begins to decrease can be adjusted by turning pressure adjusting cap 38 to thereby vary the force of reaction spring RS.

Figure 4:
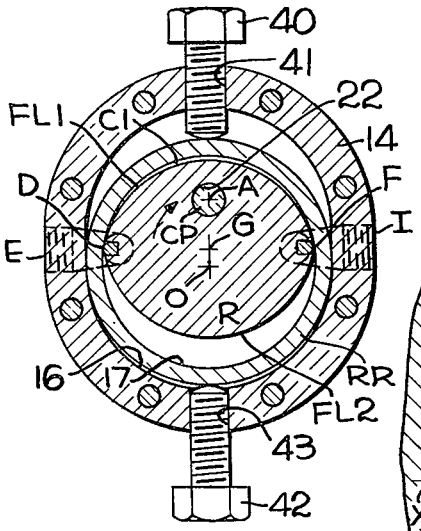
FIG. 4 is a partial view of the device of FIG. 1 illustrating alternative means to selectively adjust the volume of fluid displaced.

FIG. 4 illustrates an alternative embodiment wherein the means for selectively varying the position of chamber-defining reaction ring RR within cavity 16 to thereby selectively adjust the fluid displacement is shown as a bolt 40 extending through a threaded radially extending aperture 41 in the circumference of intermediate section 14 and engaging reaction ring RR so that turning of bolt 40 from the exterior of housing 10 will change the eccentricity e between the axis C of crankshaft CS and the axis O of reaction ring RR. A bolt 42 extending through a threaded aperture 43 in the circumference of intermediate section 14 diametrically opposite bolt 40 may provide a stop for reaction ring whose position may be selectively varied.

Figure 6:
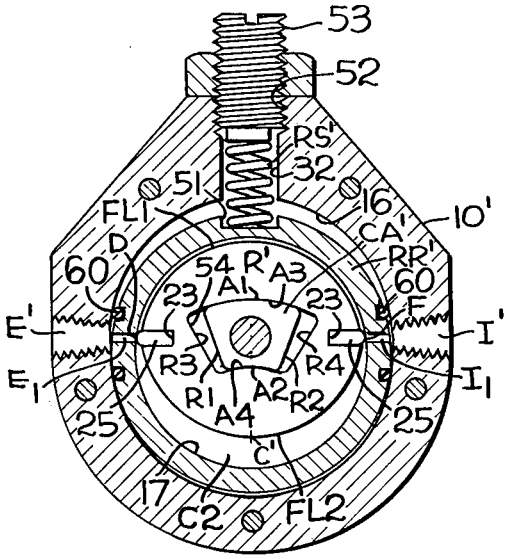
FIGS. 6 and 7 are radial and axial cross section views respectively taken through a pressure compensated, variable volume rotary piston device embodying the invention and having alternative motion transmitting means between rotary piston and crankshaft.
Figure 7:
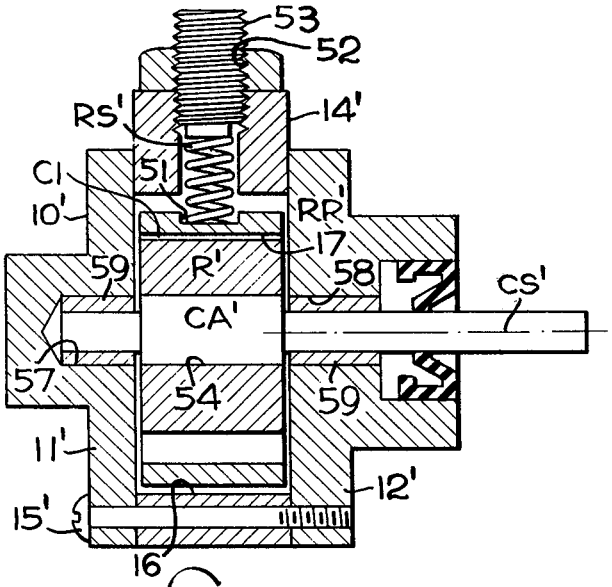
Figure 9:
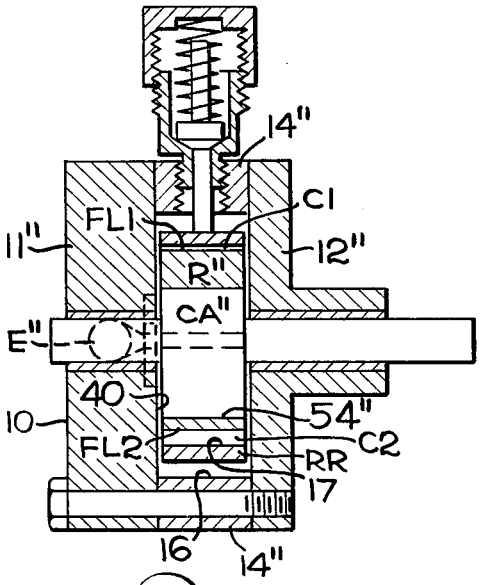
FIG. 9 is a cross section view taken radially through the assembled device of FIG. 8.
Figure 8:
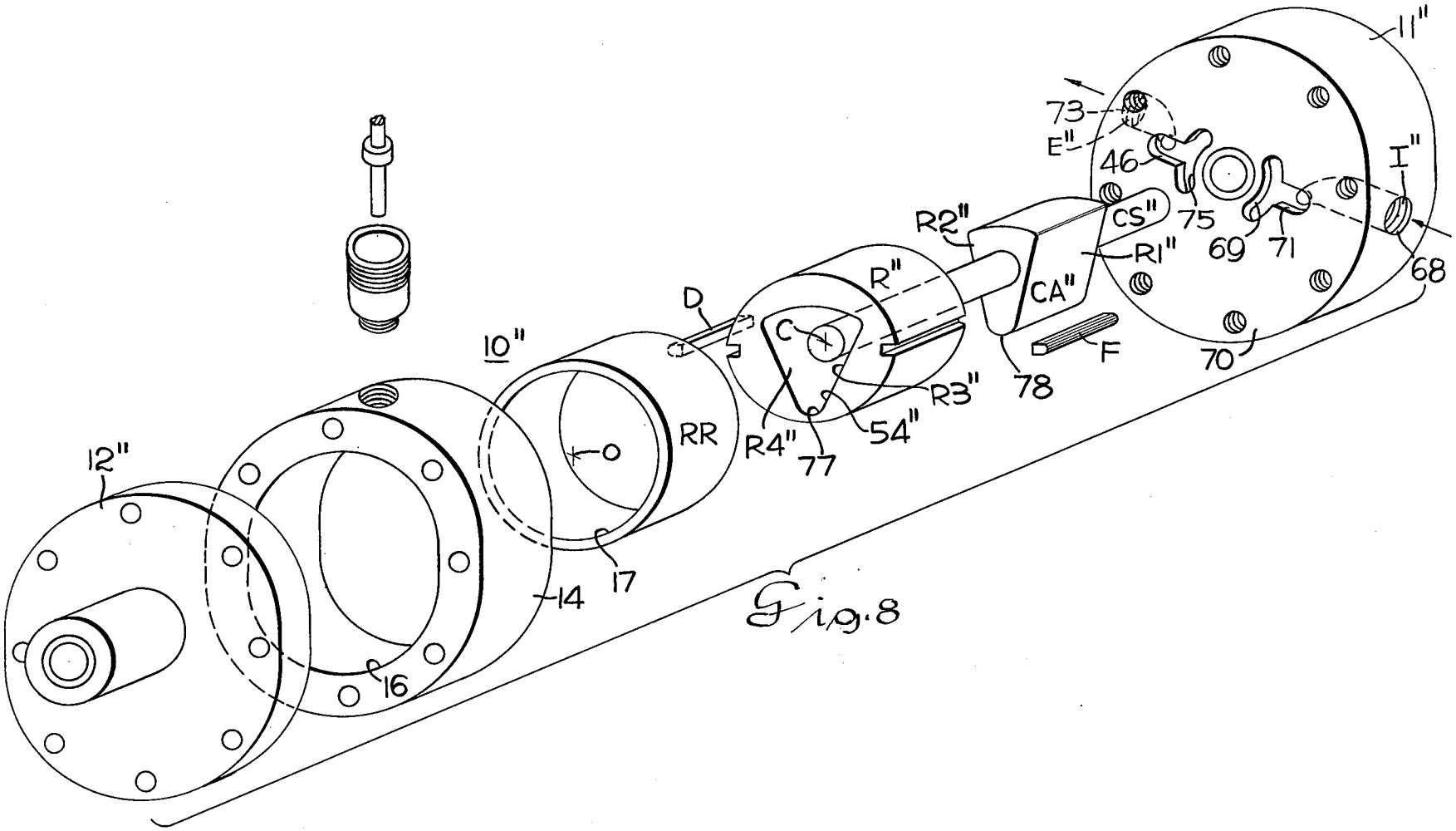
FIG. 8 is an exploded view of a variable volume, rotary piston device embodying the invention which reduces ripple in the flow when the device is operated as a pump and permits starting under load when operated as a hydraulic motor.

FIGS. 6 and 7 illustrate an alternative embodiment of variable volume, pressure compensated pump embodying the invention wherein different crankarm means operatively connect the crankshaft and the piston and also the suction and discharge ports are in circumferential portions of the housing. Elements identical to those of the FIGS. 1–3 embodiment are given the same reference numerals, and those similar to elements of the FIGS. 1–3 embodiment are given the same reference numerals with the addition of the prime ' designation. The pump has a housing 10' with end sections 11' and 12' and intermediate section 14' held together by a plurality of screws 15'. Intermediate section 14' has an axially extending, cylindrical internal cavity 16, a radially extending inlet port I' communicating with cavity 16, and a radially extending discharge port E' communicating with cavity 16. The cross section of cavity 16 is elongated and preferably obround. An annular chamber-defining, or bore-defining reaction ring RR' is positioned within internal cavity 16 and is free to move along the longitudinal axis of cavity 16. The cross section of internal cylindrical wall 17 in reaction ring RR' which forms the working chamber surface is defined by curve U and may be circular or elliptical. Reaction ring RR' has radially extending openings $I_1$ and $E_1$ which register with inlet port I' and exhaust port E' respectively in housing 10'. One end of a helical reaction spring RS' is seated in a cavity 51 in the circumference of reaction ring RR' and its other end extends into a radially extending threaded hole 52 in intermediate housing section 14' and abuts against a pressure adjusting screw 53 engaged in threaded hole 52 to thereby resiliently urge reaction ring RR' toward one end of cavity 16. End housing sections 11' and 12' have coaxial, axially extending apertures 57 and 58 respectively receiving annular bearing 59 in which a crankshaft CS' is rotatably journalled so that it protrudes through reaction ring RR'. Crankshaft CS' has an integral, four-sided crankarm CA' of sector-shaped cross section positioned within reaction ring RR'. Crankarm CA' has a pair of opposed arcuate sides A1 and A2 drawn from a common center C' adjacent the flank FL2 of rotary piston R' and also has a pair of opposed radial sides R1 and R2 defined by radii emanating from common center C'.

Rotary piston R' is of lenticular cross section and is positioned within reaction ring RR' for rotation and radial reciprocation therein so that its apices D and F have continuous sliding and sealing engagement with the internal wall 17 of reaction ring RR' which defines the cylindrical working chamber. Apices D and F have seal slots 23 which slidably receive seal plates 25 that engage the working chamber surface.

Rotary piston R' has a four-sided crankarm-receiving aperture 54 whose cross section is sector-shaped and similar to that of crankarm CA' so that crankarm CA' is free to slide within aperture 54 and thereby pivotally couple rotary piston R' to crankshaft CS' for relative rocking or pivotal movement therebetween as they rotate together within the working chamber 17 in a one-to-one ratio. Aperture 54 has a pair of opposed arcuate sides A3 and A4 drawn from common center C' and a pair of opposed radial sides R3 and R4 which emanate from center C' but subtend a greater angle that the radial sides R1 and R2 of sector-shaped crankarm CA' so that crankarm CA' has limited pivotal movement relative to rotary piston R'. As lenticular rotary piston R' rotates together with crankshaft CS' within bore 17 in reaction ring RR', apices D and F are so cammed on working chamber surface 17 that rotary piston R' pivots relative to crankarm CA' about arcuate side A4 so as to maintain the longitudinal axis DF of its lenticular cross section perpendicular to the rotatable reference diameter through curve center O in all positions of piston R' and in all positions of chamber-defining member RR' within cavity 16 and also reciprocates radially within bore 17 so that the geometric center of its lenticular cross section moves along said reference diameter and its flanks FL1 and FL2 approach toward and recede away from working chamber surface 17 in reaction ring RR' and thereby vary the volume of chambers C1 and C2 formed between its flanks and internal wall 17 in reaction ring RR' defining the working chamber. Although crankarm CA' does not carry a crankpin which establishes the point of pivotal connection between piston and crankarm as in the FIGS. 1—3 embodiment, it will be appreciated that a theoretical point of pivoting exists on arcuate surface A4 which is radially outward from geometric center G of the lenticular cross section and through which the reference diameter extends.

Reaction spring RS' seated within cavity 51 prevents turning of reaction ring RR' within internal cavity 16 but urges reaction ring RR' to a maximum volumetric displacement (minimum discharge pressure) position against one end of internal cavity 16 wherein the axis of crankshaft CS' is offset from the center O of curve U (which defines the cross section of cylindrical bore 17) in a direction along the longitudinal axis of cavity 16. The eccentricity *e* between the axes of crankshaft CA' and bore 17 is maximum in the position shown in FIGS. 6 and 7, and consequently the displacement i.e., the variation between the mimimum and maximum volumes of chambers C1 and C2) is greatest in this position of maximum eccentricity.

As the flow of liquid through discharge port E' is throttled, pressure builds up within the chambers C1 and C2 formed between rotary piston R' and reaction ring RR', thereby moving reaction ring RR' against the force of spring RS. As reaction ring RR' is displaced upward against reaction spring RS', the eccentricity e diminishes, thereby reducing the displacement of the pump. The reaction ring RR' moves against the force of reaction spring RS' until a state of equilibrium is reached wherein the internal pressure, created by rotary piston R' being displaced toward working chamber surface 17, is balanced by pressure being pumped against. As the discharge pressure increases and the axis of cylindrical bore 17 approaches the axis of crankshaft CS', the reaction ring RR' approaches a minimum volumetric displacement position wherein the compression of spring RS' is greatest and eccentricity *e* and displacement approach zero.

The external periphery of reaction ring RR' preferably has circular depressions surrounding radial openings $I_1$ and $E_1$ in which O-ring gaskets 60 are compressed between reaction ring RR' and internal cavity 16 to prevent liquid flowing through the inlet and discharge ports I' and E' from being bypassed into internal cavity 16.

FIGS. 8–11 illustrate a variable displacement rotary piston device embodying my invention which reduces ripple in the output flow when operated as a pump and which, when operated as a hydraulic motor, has more constant speed than prior art devices. The embodiment of FIGS. 8–11 displaces fluid in the same direction in two different chambers simultaneously and such fluid displacements are out of phase so that the peak of one is at the node of the other with the result that ripple is minimized in the total delivery curve when the device operates as a pump. Further, the magnitude of both such fluid displacements vary as a function of eccentricity between the axes of the crankshaft and the cylindrical bore. The embodiment of FIGS. 8–11 utilizes motion transmitting crankarm means analogous to the FIGS. 6, 7 embodiment but has novel inlet and exhaust ports which, when the device operates as a pump, provide displacement of fluid at the rotary piston flanks through the discharge port and also provide displacement of fluid by the crankarm through the discharge port which is maximum at the nodes of the sinusoidal output curve that graphs total delivery by the rotary piston flanks to thereby minimize ripple in the delivery of the pump.

Elements similar to those of the FIGS. 1–3 and FIGS. 6, 7 embodiments are given the same reference numerals while those analogous thereto are given the same reference numerals with the double prime (") designation, and their description will not be repeated. Rotary piston R" is rotatable and radially reciprocable within a cylindrical bore 17 formed by the internal wall in a reaction ring RR which is movable longitudinally in elongated cavity 16 in intermediate section 14" in housing 10". Rotary piston R" has a generally sector-shaped compartment 54" which receives a generally sector-shaped crankarm CA" that is integral with crankshaft CS" in a manner analogous to the FIGS. 6, 7 embodiment. Inlet port I" and exhaust or discharge port E" are both in housing end section 11". The radially outer end 68 of inlet port I' is in the circumference of end section 11", and inlet port I" at its radially inner end includes an arcuate portion 69 in the axially facing surface 70 of end section 11"which registers with compartment 54" in rotary piston R" and merges into a radially outward extending portion 71 that communicates with variable volume chambers C1 and C2 formed respectively between rotary piston flanks FL1 and FL2 and reaction ring internal wall which defines bore 17. Exhaust port E" is disposed diametrically opposite from inlet port I" and is similar thereto in having its radially outer end 73 in the circumference of end section 11" and having the radially inner end thereof in the axially facing surface 70 of end section 11" including an arcuate opening 75 in surface 70 that communicates with compartment 54" in rotary piston R" and which merges into a radially outward extending portion 76 that registers with variable volume chambers C1 and C2.

Rotary piston R" is of lenticular cross section and has compartment 54" therein of generally sector-shaped cross section partially defined by two diverging radial wall portions R3" and R4" which at their converging ends merge into an arcuate bearing wall portion 77 that defines the area of driving connection between crankarm CA" and rotary piston R" and is disposed radially outward from the geometric center of the cross section of rotary piston R''. Generally sector-shaped motion transmitting crankarm CA'' has converging radial wall portions R1'' and R2'' and also has a rounded force transmitting tip 78 adjacent its narrow end in abutting relation with bearing wall portion 77 of rotary piston R''.

Sector-shaped compartment 54'' subtends fa substantially greater central angle than that subtended by sector-shaped crankarm CA'' so that crankarm CA'' is free to rock or pivot within compartment 54'' while piston R'' and crankshaft CS'' rotate together in a one-to-one ratio with bore 17 in reaction ring RR. The rounded tip 78 of crankarm CA'' pivots within bearing wall portion 77 of rotor R'' to provide a force transmitting connection therebetween about a point which is displaced radially outward from geometric center G of piston R'' and is analogous to crankpin axis A of the embodiment of FIGS. 1–3. Apices D and F of rotary piston R'' remain in continuous sliding contact with bore 17 and so cam rotary piston R'' as it rotates together with crankshaft CS'' that the longitudinal axis DF of the rotary piston cross section remains perpendicular to the rotatable reference diameter OGA which intersects the center O of the closed curve that defines the cross section of bore 17 in all positions of rotary piston R'' within bore 17.

The crankarm radial walls R1'' and R2'' together with the respective opposing radial walls R3'' and R4'' of the piston R'' form pumping cavities PC1 and PC2 (see FIG. 10) on opposite sides of crankarm CA'' out of which crankarm CA'' displaces or squeezes fluid through exhaust port E'' and which fluid displacement is in addition to the fluid displaced by flanks FL1 and FL2 from variable volume chambers C1 and C2 when the device operates as a pump. The magnitude of fluid displacment by piston flanks FL1 and FL2 from variable volume cavities C1 and C2 is proportional to the eccentricity *e* and similarly the magnitude of fluid displaced by crankarm CA'' from pumping cavities PC1 and PC2 is also proportional to eccentricity *e*.

FIG. 10 schematically illustrates successive positions or rotary piston R'' spaced 60° apart as it rotates in the clockwise direction within bore 17 in reaction ring RR and shows intake port I'' and discharge port E'' in dotted lines. At the top dead center (TDC) position shown in FIG. 10*a*, flank FL1 is closely adjacent bore 17 so the volume of chamber C1 is minimum; flank FL2 has maximum spacing from bore 17 so the volume of chamber C2 is maximum; neither chamber C1 or C2 registers with intake port I'' or exhaust port E'' so that displacement (in the sense of fluid delivery) by flanks FL1 and FL2 through the ports is minimum; sector-shaped compartment 54'' in piston R'' registers with arcuate portion 69 of intake port I'' and also with arcuate portion 75 of discharge port E'' so that fluid is being squeezed out of pumping cavity PC1 by radial wall portion R1'' of clockwise rotating crankarm CA'' moving toward radial wall R3'' of rotary piston R'' and fluid is simultaneously being inducted into pumping cavity PC2 through arcuate portion 69 of intake port I'' by crankarm radial wall R2'' moving away from piston radial wall R4''. It will be noted that displacement of fluid by crankarm CA'' is 90° out of phase with fluid displacement by flanks FL1 and FL2 of piston R''.

Figures 10B, 10C, 10D, 10E, 10F, 11:
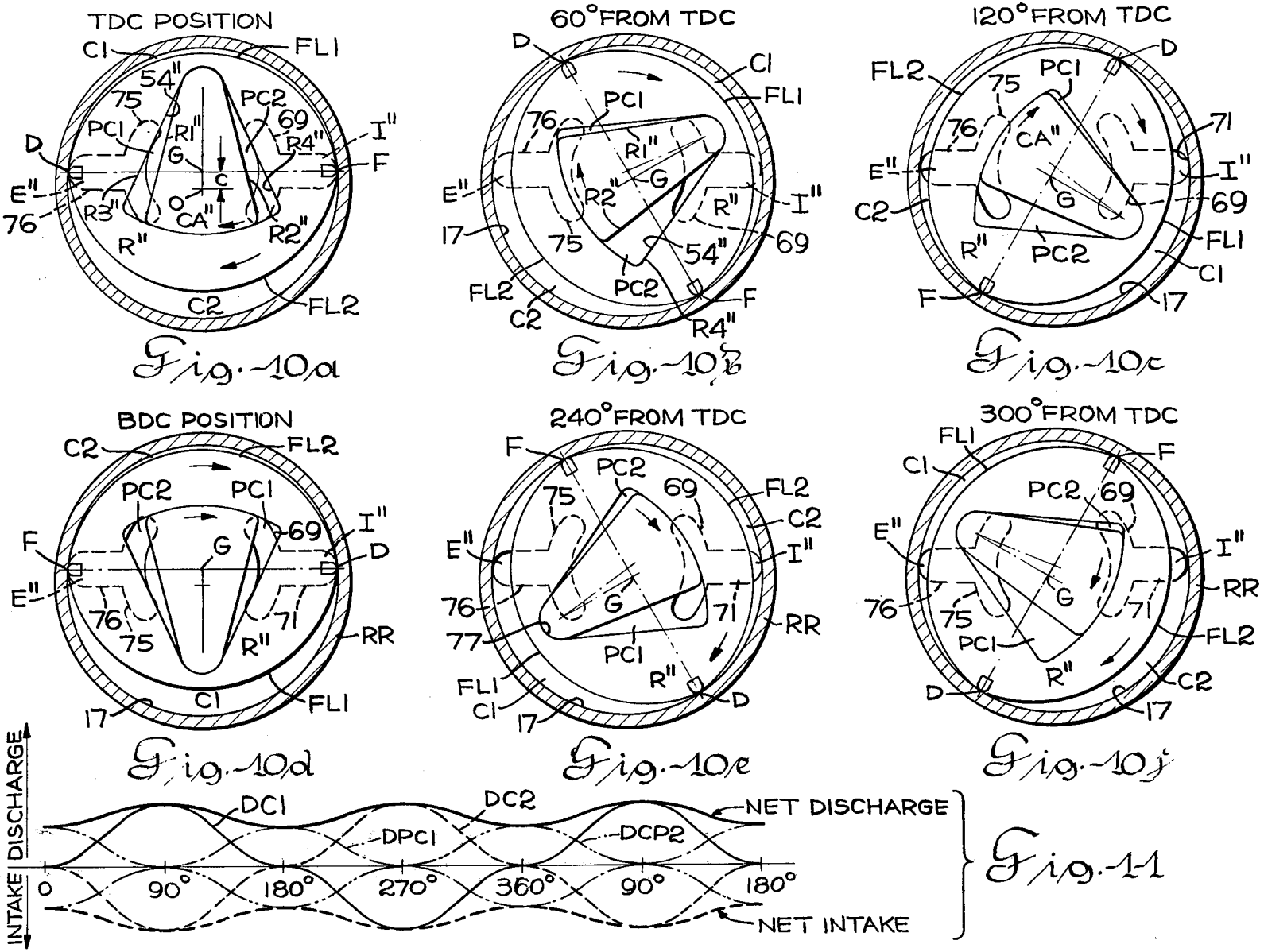

After 60° clockwise rotation of crankshaft CS'' from top dead center, rotary piston R'' has rocked relative to crankarm CA'' as shown in FIG. 10*b* and the geometric center G of its lenticular cross section has reciproacted along the reference diameter so that rotary piston flank FL1 has receded away from bore 17 and chamber C1 communicates with radial portion 71 of intake port I'' and is inducting fluid therein; rotary piston flank FL2 has moved toward bore 17 and is displacing fluid out of radial portion 76 of discharge port E''; compartment 54'' in rotary piston R'' still registers with both arcuate portion 75 of discharge port E'' and with arcuate portion 69 of intake port I'' so that radial wall portion R1'' of crankarm CA'' is squeezing fluid out from pumping cavity PC1 through arcuate portion 75 of discharge port E'' and fluid displacement by crankarm CA'' is approaching minimum; and radial wall portion R2'' of crankarm CA'' is still receding from piston wall portion R4'' so that the volume of pumping cavity PC2 is approaching maximum and it still registers with arcuate portion 69 of intake port I'' so that fluid is being inducted into PC2.

After 90° rotation of crankshaft CS'' from TDC (not shown), displacement of fluid by piston flank FL2 through radial portion 76 of discharge port E'' is maximum and displacement of fluid by crankarm wall portion R1'' out of pumping cavity PC1 is minimum. In FIG. 11 the fluid displacement in chambers C1, C2, PC1 and PC2 through the intake and exhaust ports is respectively designated DC1, DC2, DPC1 and DPC2, and it will be noted from FIG. 11 that at 90° from TDC displacement DC1 by flank FL1 from chamber C1 through discharge port E'' is approximately 90° out of phase with fluid displacement DPC1 by crankarm CA'' from pumping cavity PC1 through discharge port E''.

After 120° clockwise rotation of crankshaft CS'' from TDC shown in FIG. 10*c*, rotary piston R'' has rocked through a different angle relative to crankarm CA'' and its geometric center G has reciprocated along the reference diameter so that flank FL1 has receded further from bore 17 and chamber C1 still registers with radial portion 71 of intake port I'' and is inducting fluid therein; flank FL2 has approached closer to bore 17 while chamber C2 remains in communication with radial portion 76 of discharge port E''; pumping cavity PC1 no longer communicates with discharge port E'' and now registers with arcuate portion 69 of intake port I'' and is inducting fluid therein; and pumping cavity PC2 no longer registers with intake port I'' but rather communicates with arcuate portion 75 of discharge port E'' so that fluid is being displaced by crankarm CA'' from PC2 through port E''.

After 180° clockwise rotation of crankshaft CS'' from TDC to bottom dead center (BDC) position shown in FIG. 10*d*, rotary piston R'' is returned to a position wherein its geometric center G is again coincident with the axis of crankshaft CS''; flank FL2 of rotary piston R'' is closely contiguous the portion of bore 17 intersected by the minor diameter (coordinate axis Y) of the curve which defines the cross section of bore 17 and the volume of chamber C2 is minimum; flank FL1 has maximum spacing from bore 17 so volume of chamber C1 is maximum; neither chamber C1 or C2 register with intake port I'' or discharge port E'' so that fluid displacement (i.e., delivery) by flanks FL1 and FL2 through exhaust port E'' is minimum; pumping cavities PC1 and PC2 respectively register with intake port arcuate portion 69 and with discharge port arcuate portion 75 and fluid displacement DPC1 ad DPC2 therein is maximum.

After 240° from TDC clockwise rotation of crankshaft CS'' shown in FIG. 10*e*, rotary piston R'' has rocked relative to crankarm CA'' so that the longitudinal axis DF of its cross section is no longer perpendiculr to the longitudinal axis of crankarm CA''; said longitudinal axis DF of piston R'' remains perpendicular to the rotatable reference diameter OGA through geometric center G, the center O of the bore cross secton curve, and the point 77 of pivotal coupling between crankarm CA'' and piston R''; the geometric center G of the rotary piston cross section has reciprocated along the reference diameter as the piston rotated so that flank FL2 has receded away from bore 17 and chamber C2 has increased in volume and registers with intake port radial portion 71 and is inducting fluid therein; flank FL1 has approached toward bore 17 and is displacing fluid from chamber C1 through discharge port radial portion 76; pumping cavity PC1 still overlaps slightly with intake arcuate portion 69 and pumping cavity PC2 still has slight overlap with discharge port arcuate portion 75; and fluid displacement in both pumping cavities PC1 and PC2 is approaching minimum.

After 300° clockwise rotation of crankshaft CS'' from TDC shown in FIG. 10*f*, flank Fl1 is approaching TDC and is displacing fluid from chamber C1 through radial portion 76 of discharge port E''; flank FL2 is receding from bore 17 so the volume of chamber C2 is increasing and chamber C2 registers with the radial portion 71 of intake port I'' and is inducting fluid therein; pumping cavity PC1 registers with arcuate portion 75 of discharge port E'' and fluid displacement therein is approaching maximum; and pumping cavity PC2 registers with arcuate portion 71 of intake port I'' so that fluid is being inducted into PC2.

FIG. 11 plots fluid displacement through exhaust port E'' and intake port I'' versus rotation of shaft CS'' from top dead center and shows that fluid displacement DC2 and DC1 in chambers C2 and C1 by flanks FL2 and FL1 respectively is maximum at 90° and 270° from TDC whereas fluid displacement DPC1 and DPC2 by crankarm CA'' in pumping cavities PC1 and PC2 is respectively maximum at approximately 0° and at 180° from TDC and that, consequently, the net flow from the disclosed pump has minimum ripple in the output delivery in comparison to the other embodiments wherein only flanks FL1 and FL2 displace fluid.

It will be appreciated that the approximately ninety degree out of phase relation between fluid displacements DC1, DC2 by the rotary piston flanks from the fluid displacements DPC1, DPC2 by crankarm CA'' will permit self-starting when the device operates as a hydraulic motor.

FIG. 10 illustrates only one position of reaction ring RR within elongated cavity 16, and it will be appreciated that the degree of overlap of pumping cavities PC1 and PC2 with inlet port I'' and with discharge port E'' varies with the eccentricity e between the axis of shaft CS'' and bore 17. However, maximum fluid displacement by crankarm CA'' in pumping cavities PC1 and PC2 remain approximately 90° out of phase from maximum displacement in chambers C1 and C2 by flanks FL1 and FL2 regardless of eccentricity *e*. Further the magnitude of fluid displacement DC1, DC2 through the intake and exhaust ports in both chamber C1 and C2 and the fluid displacements DPC1, DPC2 in pumping cavities PC1 and PC2 through the intake and exhaust ports will vary with eccentricity e but the magnitude of all such displacements will vary in proportion to the eccentricity *e* and in the same direction.

Although the rotary piston of all of the disclosed embodiments rocks or pivots relative to the crankarm, alternative embodiments of my invention are similar to the construction shown in FIGS. 12 and 13 of my aforesaid application Ser. No. 553,332 wherein the force transmitting means between shaft and rotary piston is a scotch yoke arrangement and a phase link reciprocates the rotary piston as it rotates together with the shaft so that the geometric center of its cross section reciprocates along the rotatable reference diameter.

While only a few embodiments of my invention has been illustrated and described, many modifications and variations thereof will be readily apparent to those skilled in the art, and consequently it should be understood that I do not intend to be limited to the particular embodiments shown and described.

The embodiments of the invention in which an exclusive property or privilege is claimed are defined as follows:

1. A rotary piston, variable volume device comprising, in combination, a housing having an elongated cavity therein and spaced inlet and exhaust ports which communicate with said cavity, a shaft rotatably journalled in said housing and extending into said cavity, a chamber-defining member positioned within said cavity and having an internal cylindrical bore surrounding said shaft whose cross section is a closed curve, a cylindrical rotary piston rotatable within said bore with its axis parallel to the shaft axis and having first and second arcuately spaced apices which divide said bore into first and second variable volume chambers on opposite sides of said rotary piston, means including a force transmitting member carried by said shaft for operatively coupling said piston to said shaft so that they rotate together in a one-to-one ratio while concurrently permitting rocking movement of said rotary piston relative to said force transmitting member and to said shaft about a surface radially removed from the geometric center of the piston cross section and so that said first and second apices remain in continuous contact with said bore in all positions of said shaft, said force transmitting member constituting the sole motion controlling means between said shaft and said rotary piston and said first and second apices being cammed on said bore so that said rotary piston reciprocates within said bore as it rotates together with said shaft and varies the volumes of said first and second chambers inversely from minimum to maximum and back to minimum during each revolution of said shaft, said chamber-defining member being movable within said cavity in a direction longitudinal of said cavity to vary the eccentricity between the axis of said shaft and the center of said closed curve defining said bore cross section and thus change the volumetric displacement of said device.

2. A rotary piston variable volume device in accordance with claim 1 and including means for selectively varying the position of said chamber defining member within said cavity to thereby selectively adjust the fluid displacement.

3. A rotary piston variable volume device in accordance with claim 1 wherein said inlet and exhaust ports are in radially extending portions of said housing adjacent in an axial end of said rotary piston.

4. A rotary piston variable volume device in accordance with claim 1 wherein said means for operatively coupling permits pivoting of said rotary piston relative to said force transmitting member and to said shaft about an axis radially removed from the geometric center of the piston cross section and including resilient means within said cavity for urging said chamber-defining member toward a position wherein the axis of said shaft is eccentric to said center of said closed curve, whereby said device is pressure compensated and volumetric displacement is maximum when fluid pressure is minimum.

5. A rotary piston variable volume device in accordance with claim 4 and including means accessible from the exterior of said housing for selectively varying the force exerted by said resilient means, thereby permitting selective control of fluid displacement.

6. A rotary piston, variable volume device in accordance with claim 1 wherein said force trasmitting member is a crankarm and constitutes the sole force transmitting means between said piston and said shaft.

7. A rotary piston variable volume device in accordance with claim 6 wherein said means for operatively coupling said piston to said shaft cams said first and second apices on said bore so that a straight line connecting said first and second apices remains perpendicular to a rotatable reference diameter through the center of said closed curve in all positions of said rotary piston within said bore and in all positions of said chamber-defining member within said cavity.

8. A rotary piston variable volume device in accordance with claim 7 wherein said geometric center of said piston cross section lies along said straight line connecting said first and second apices and said means for operatively coupling said piston to said shaft so cams said first and second apices on said bore that said geometric center reciprocates along said reference diameter as said piston revolves within said bore.

9. A rotary piston variable volume diveice in accordance with claim 8 and including resilient means within said cavity for urging said chamber defining member toward a position wherein the axis of said shaft is eccentric to the center of said closed curve defining the cross section of said bore, whereby said device is pressure compensated.

10. A rotary piston, variable volume device in accordance with claim 6 wherein said rotary piston rocks relative to said crankarm as they rotate together and has a crankarm-engaging surface about which said rotary piston pivots relative to said carnkarm which is displaced from the geometric center of said piston cross section by a distance approximately equal to the radius of the crankcircle of said crankarm.

11. A rotary piston variable volume device in accordance with claim 10 wherein said chamber-defining member is an annular reaction ring and said rotary piston is lenticular in cross section.

12. A rotary piston variable volume device in accordance with claim 10 wherein said crankarm carries a crankpin and said piston has a crankpin receiving aperture into which said crankpin extends and which defines said surface about which said piston rocks relative to said shaft.

13. A rotary piston variable volume device in accordance with claim 10 wherein the cross section of said crankarm is bounded on three sides by two radially extending lines and the included arc of a circle, and said rotary piston has a crankarm-receiving aperture whose cross section is similar to that of said crankarm but subtends a larger arc and said aperture freely receives said crankarm so that said rotary piston rotates together with, but is free to pivot relative to, said crankarm.

14. A rotary piston variable volume device in accordance with claim 13 wherein both said crankarm and said crankarm-receiving aperture are generally sector-shaped in corss section, said crankarm has a rounded vertex, and said crankarm-receiving aperture has a rounded wall portion joining its radial sides in which said crankarm vertex pivots and which constitutes said crankarm-engaging surface displaced from said geometric center of said piston cross section.

15. A rotary piston variable volume device in accordance with claim 13 where both said crankarm and said crankarm-receiving aperture have four-sided cross sections bounded by two radially extending lines and two radially-spaced included arcs of a circle so that said piston is free to rock, but cannot move radially, relative to said crankarm as they rotate together in a one-to-one ratio.

16. A rotary piston variable volume device in accordance with claim 13 wherein said chamber defining member is an annular reaction ring and said rotary piston is lenticular in cross section.

17. A rotary piston, variable volume device comprising, in combination, a housing having an elongated cavity therein and spaced inlet and discharge ports which register with said cavity, an annular reaction ring disposed in and movable within said cavity, the inner diameter of said reaction ring forming a chamber for said device, a lenticular-in-cross-section rotary piston positioned within said chamber, a shaft rotatably journalled within said housing and carrying a crankarm, and means for operatively coupling said rotary piston to said crankarm so that said shaft and piston rotate together in a one-to-one ratio while permitting said piston to pivot relative to said crankarm so that the apices of the lenticular piston remain in continuous contact with the inner diameter of said reaction ring in all positions of said piston and vary the volume of first and second chambers formed on opposite sides of said piston inversely from minimum to maximum and back to minimum during each revolution of said shaft, said crankarm constituting the sole motion controlling means between said piston and said shaft, and said means for operatively coupling engaging said rotary piston at a surface displaced laterally from a straight line connecting its apices, said reaction ring being movable longitudinally of said cavity to vary the eccentricity between the axis of said shaft and the center of the circle defining the inner circumference of said reaction ring and thus change the volumetric displacement of said device.

18. A rotary piston variable volume device in accordance with claim 17 and including means for selectively varying the position of said reaction ring within said cavity.

19. A rotary piston variable volume device in accordance with claim 17 wherein said inlet and discharge ports are in radially extending portions of said housing adjacent an axial end of said rotary piston.

20. A rotary piston variable volume device in accordance with claim 17 and including resilient means within said cavity for resiliently urging said reaction ring toward a position wherein the axis of said shaft is eccentric to the center of the circle defining the inner circumference of said reaction ring, whereby said device is pressure compensated and volumetric displacement is maximum when fluid pressure is minimum.

21. A rotary piston variable volume device in accordance with claim 20 and including means accessible from the exterior of said housing for selectively varying the force exerted by said resilient means against said reaction ring thereby permitting selective control of fluid displacement when said device operates as a pump.

22. A rotary piston variable volume device in accordance with claim 21 wherein the geometric center of the lenticular cross section of said piston lies along said straight line connecting its apices, and said rotary piston pivots relative to said crankarm about a pivot axis which is displaced from said geometric center and from the axis of shaft by appromixately equal distances.

23. A rotary piston variable volume device in accordance with claim 22 wherein said crankarm carries a crankpin whose axis is coincident with said pivot axis and said rotary piston has a crankpin-receiving aperture whose axis is coincident with said pivot axis.

24. A rotary piston variable volume divice in accordance with claim 22 wherein the cross section of said crankarm is bounded on three sides by two radially extending lines and the included arc of a circle, and said rotary piston has a crankarm-receiving aperture whose cross section is similar to that of said crankarm but subtends a larger arc, and said aperture freely receives said crankarm so that said rotary piston is free to rock relative to said crankarm as they rotate together in a one-to-one ratio.

25. A rotary piston variable volume device in accordance with claim 22 wherein said means for operatively coupling so cams said apices of said lenticular piston on said inner diameter of said reaction ring that said straight line remains perpendicular to a rotatable reference diameter through the center of the circle defining the reaction ring inner circumference in all positions of said piston within said chamber and also in all positions of said reaction ring within said cavity.

26. A rotary piston variable volume device in accordance with claim 25 wherein said means for operatively coupling so cams said apices of said piston on said inner circumference of said reaction ring that said geometic center reciprocates along said reference diameter as said piston revolves within said chamber.

27. A rotary piston variable volume device comprising, in combination, a housing having an elongated cavity therein and spaced inlet and exhaust ports which communicate with said cavity, a shaft rotatably journalled in said housing, a chamber-defining member positioned in and movable within said cavity and having an internal cylindrical bore whose cross section is a closed curve, a cylindrical rotary piston rotatable within said bore with its axis parallel to the shaft axis and having first and second arcuately spaced apices which divide said bore into first and second variable volume chambers on opposite sides of said piston, means including a force transmitting member carried by said shaft for operatively coupling said shaft to said rotary piston so that they rotate together in a one-to-one ratio while concurrently permitting movement of said piston relative to said force transmitting member so that said first and second apices remain in continuous engagement with said bore in all positions of said rotary piston and so that a straight line connecting said first and second apices remains perpendicular to a rotatable reference diameter through the center of said closed curve in all positions of said piston within said bore and in all positions of said chamber-defining member within said cavity, said means for operatively coupling so camming said first and second apices on said bore that each said chamber alternatively communicates with said inlet port and with said exhaust port and also so that each first and second chambers vary inversely in volume from minimum to maximum and back to minimum during each revolution of said shaft, said chamber-defining member being movable longitudinally of said cavity to vary the eccentricity between the axis of said shaft and said center of said closed curve and thereby change the volumetric displacement of said device.

28. A rotary piston variable volume device in accordance with claim 27 wherein said inlet and discharge ports are in radially extending portions of said housing adjacent an axial end of said piston, and including resilient means within said cavity for urging said chamber-defining member to a position wherein said axis of said shaft is eccentric to the center of said closed curve defining the cross section of said bore.

29. A rotary piston variable volume device in accordance with claim 27 wherein said means for operatively coupling so cams said first and second apices on said bore that the geometric center of the rotary piston cross section reciprocates along said rotatable reference diameter as said shaft rotates.

30. A rotary piston variable volume device in accordance with claim 29 wherein said force transmitting member is a crankarm and constitutes the sole force transmitting means between said shaft and said piston.

31. A rotary piston variable volume device in accordance with claim 30 wherein said rotary piston pivots relative to said carnkarm about a pivot axis which is displaced radially by approximately equal distances from said crank axis and from the geometric center of said piston cross section.

32. A rotary piston variable volume device in accordance with claim 31 wherein said crankarm carries a pivot pin which is coincident with said pivot axis and said piston has a crankpin receiving aperture which is coincident with said pivot axis.

33. A rotary piston variable volume device in accordance with claim 31 wherein the cross section of said crankarm is bounded on three sides by two radially extending lines and the included arc of a circle and said rotary piston has an aperture which freely receives said crankarm and whose cross section is similar to that of said crankarm but subtends a larger arc and permits said piston to rock relative to said crankarm as they rotate together in a one-to-one ratio.

34. A rotary piston variable volume device in accordance with claim 31 wherein said chamber-defining member is an annular reaction ring and said rotary piston is lenticular in cross section.

35. A rotary piston variable volume device in accordance with claim 31 and including means for selectively vary9ing the position of said chamber defining member within said cavity.

36. A rotary piston variable volume device in accordance with claim 31 and including resilient means within said cavity for urging said reaction ring toward a position wherein the axis of said shaft is eccentric to the center of said reaction ring, whereby said device is pressure compensated and volumetric displacement is maximum where fluid pressure is minimum.

37. A rotary piston variable volume device in accordance with claim 36 and including means accessible from the exterior of said housing for selectively varying the force exerted by said resilient means against said reaction ring, thereby permitting selective control of delivery when said device operates as a pump.

38. A rotary piston variable volume device in accordance with claim 37 wherein said inlet and discharge ports are in radially extending portions of said housing adjacent an axial end of said rotary piston.

* * * * *